US007445417B2

(12) United States Patent
Furthmüller

(10) Patent No.: US 7,445,417 B2
(45) Date of Patent: Nov. 4, 2008

(54) UPWARD AND DOWNWARD STACKING SHAFT HAVING A TRAY PIVOTING MECHANISM

(75) Inventor: Stefan Furthmüller, Welzheim-Breitenfürst (DE)

(73) Assignee: Wilhelm Bahmueller Maschinenbau-Praezisionswerkzeuge GmbH, Pluederhausen (DE)

( * ) Notice: Subject to any disclaimer, the term of this patent is extended or adjusted under 35 U.S.C. 154(b) by 214 days.

(21) Appl. No.: 11/129,408

(22) Filed: May 16, 2005

(65) Prior Publication Data

US 2006/0263193 A1 Nov. 23, 2006

(51) Int. Cl.
*B65G 57/03* (2006.01)
*B65G 57/00* (2006.01)
*B65H 31/30* (2006.01)

(52) U.S. Cl. ..... 414/793.4; 414/790.4; 414/793.8; 414/794.1; 271/212

(58) Field of Classification Search ..... 414/788.2, 414/790, 793.6, 793.4, 793.8, 793.9, 794, 414/794.1, 794.2, 789, 789.9, 790.1, 794.9; 271/213, 219, 220, 222, 223, 212, 217, 177
See application file for complete search history.

(56) References Cited

U.S. PATENT DOCUMENTS 2,133,727 A * 10/1938 Staude ..... 271/216
2,897,949 A * 8/1959 Huisking ..... 414/789.1
3,088,604 A * 5/1963 Nilsson ..... 414/788.2
3,744,649 A * 7/1973 Ward, Jr. ..... 414/788.7
3,866,765 A * 2/1975 Stobb ..... 414/788.8
3,892,168 A * 7/1975 Grobman ..... 414/789.1
4,111,411 A * 9/1978 Graves et al. ..... 271/199
4,460,169 A * 7/1984 Bartesaghi ..... 271/192
5,318,401 A * 6/1994 Mandel ..... 414/792.7
6,364,309 B1 * 4/2002 Tomatsu ..... 271/160

FOREIGN PATENT DOCUMENTS

DE 2361449 B * 4/1975
EP 0 359 920 3/1990

* cited by examiner

*Primary Examiner*—Saúl J Rodríguez
*Assistant Examiner*—Gregory W Adams
(74) *Attorney, Agent, or Firm*—Paul Vincent

(57) ABSTRACT

The invention concerns a device for stacking flat products, in particular, folding boxes, comprising a stack shaft for receiving the flat products which comprises an inlet opening opposite to an impinging surface, and is provided with guiding element disposed in side flanks, which guide the flat products in the form of a stack, wherein each side flank comprises a transport means for upward and downward vertical movement of a tray which projects into the stack shaft and which carries the flat products.

13 Claims, 6 Drawing Sheets

UPWARD AND DOWNWARD STACKING SHAFT HAVING A TRAY PIVOTING MECHANISM

BACKGROUND OF THE INVENTION

The invention concerns a device for stacking flat products, in particular, folding boxes, comprising a stack shaft for receiving the flat products, which has an inlet opening opposite to an impinging surface, and guiding elements disposed in side flanks, which guide the stack of flat products.

Folding box production plants conventionally terminate in a stack shaft in which the produced folding boxes are stacked into piles and from which the piles are removed. Due to great differences in shapes, sizes and folds of the folding boxes, the folding boxes must be stacked either in an upward or downward direction. Folding boxes with a relatively flat and smooth upper side are usually down-stacked. This is not possible if the upper side of the folding box is not flat or the blank has steps. A subsequent folding box could be arrested by one of these steps and become jammed. For this reason, folding boxes of this type are generally up-stacked, wherein the folding boxes are sequentially pushed below the previously deposited folding box (up-stacking).

In case of product change between two folding boxes, the stacking type may also have to be changed. Towards this end, the stack shaft must also be replaced to permit stacking in the other direction. This is time and labor consuming and therefore expensive.

It is the underlying purpose of the invention to design a device for stacking flat products of the above-mentioned type which is suited for both stacking directions.

SUMMARY OF THE INVENTION

This object is achieved in accordance with the invention with a device of the above-mentioned type in that a transport means is provided in at least one side flank for upward and downward vertical movement of a tray which projects into the stack shaft and carries flat products.

In the inventive stacking device, the tray for transporting the flat products can be moved in the upward and downward directions. For down-stacking, the stack is formed on the two trays, each provided at one side flank. The lowermost flat product of the stack is supported on these trays and the following products are disposed onto this stack, while the trays move downwards. For up-stacking, a flat product is pushed below the stack, and the product pile is lifted by the tray as soon as the required number of products has been stacked.

In a further development, the tray can be continuously and/or gradually moved, in particular, at different speeds. If the trays are continuously lowered, the stack can be formed by sequentially deposited flat products in correspondence with the lowering speed. In case of gradual lowering of the tray, the flat products may also be supplied discontinuously without disturbing the operation. As soon as the stack is completed, the trays can be moved at a higher speed to remove the stack from the stacking zone and to supply two new trays for forming a new stack. The supply of new flat products must therefore only be interrupted for a very short time.

The transport means preferably comprises two neighboring chains which drive a carriage which can be moved on a guiding rail. It is also feasible to use belts or other circulating transport means instead of the chains, which can be precisely controlled and can transfer supporting forces. The carriage connected to the chains bears one tray on which the stack is supported.

To also facilitate stacking of flat products, in particular, substantially wedge-shaped folding boxes, e.g. having a thicker front region and a thinner rear end, the tray is pivotably disposed on the carriage in accordance with the invention. In this fashion, the bottom of the stack can be inclined while the stack is being lowered to provide sufficient space for the thicker sections of the flat products. The flat products can still be disposed in a horizontal direction on top of the growing stack.

In a further development, a pivot lever is mounted to the tray via which the tray can be pivoted about a pivot bearing. This lever pivots the bottom either once or gradually to form a prisma-shaped shaft with inclined bottom for receiving the flat products.

For pivoting in accordance with the invention, the pivot lever comprises a feeler roller on its free end, wherein the feeler roller is deflected by a cam, a ramp, a forced guidance or the like. When the tray moves in a vertical direction, the feeler roller of the pivot lever moves along and is displaced out of its rest position by the cam or ramp to thereby pivot the pivot lever. The tray is thereby pivoted from its rest position into an inclined position and the bottom of the stack shaft is tilted. Pivoting can also be effected via a separate drive.

To prevent inadvertent tilting of the tray from its rest position, the tray is spring-loaded in the direction of its horizontal rest location. This spring ensures that the tray always assumes its horizontal rest position if the pivot lever is not deflected via the cam, ramp or the like, such that the product stack is located vertically above the tray.

To facilitate adjustment of the inventive device to wedge-shaped and also uniformly shaped products, the cam or ramp can be moved into or be at least partially retracted from the path of motion of the feeler roller. If uniform products are to be disposed, which do not require pivoting of the tray, the cam or ramp is displaced to such an extent that the feeler roller is not engaged. The pivot lever is thereby not pivoted and the trays remain in their horizontal rest position. If the cam or ramp is still more or less in the path of motion of the feeler roller, i.e. in the engagement region of the feeler roller, the pivot lever is more or less pivoted thereby inclining the trays.

The inclination of the cam or ramp can be adjusted to be able to stack products of different wedge shapes in a likewise proper fashion. This means that the trays can be tilted to a greater or lesser extent for a given advance. This permits depositing of both products with a slight wedge shape and products with a distinct wedge shape.

A sensor is preferably provided for detecting the stack height, wherein the sensor signal controls the transport means. The trays can thereby be gradually lowered by an amount which corresponds to the height of the product previously disposed onto the stack.

In one embodiment, the trays support the flat product in the region of its opposite side edges. The flat product and thereby the entire stack are not supported along the full surface but merely in the region of the right and left side edges. This support is dimensioned to safely hold the product such that it does not sag. The mere lateral support has the substantial advantage that the finished pile can be grasped on its lower side by a removal device without having to previously remove the pile from the trays.

The lower end of the stack shaft preferably comprises a disposal device for the product pile, wherein the trays pass the disposal device without colliding. The trays deposit the finished stack on the disposal device to be grasped and delivered by a gripper device. The stack is thereby always guided by corresponding guiding elements which secure it from being displaced until it is delivered.

BRIEF DESCRIPTION OF THE DRAWING

Further advantages, features and details of the invention can be extracted from the dependent claims and the following description which describes in detail a particularly preferred embodiment with reference to the drawing. The features shown in the drawing and mentioned in the description and claims may be essential to the invention either individually or in arbitrary combination.

DESCRIPTION OF THE PREFERRED EMBODIMENT

Figure 1:
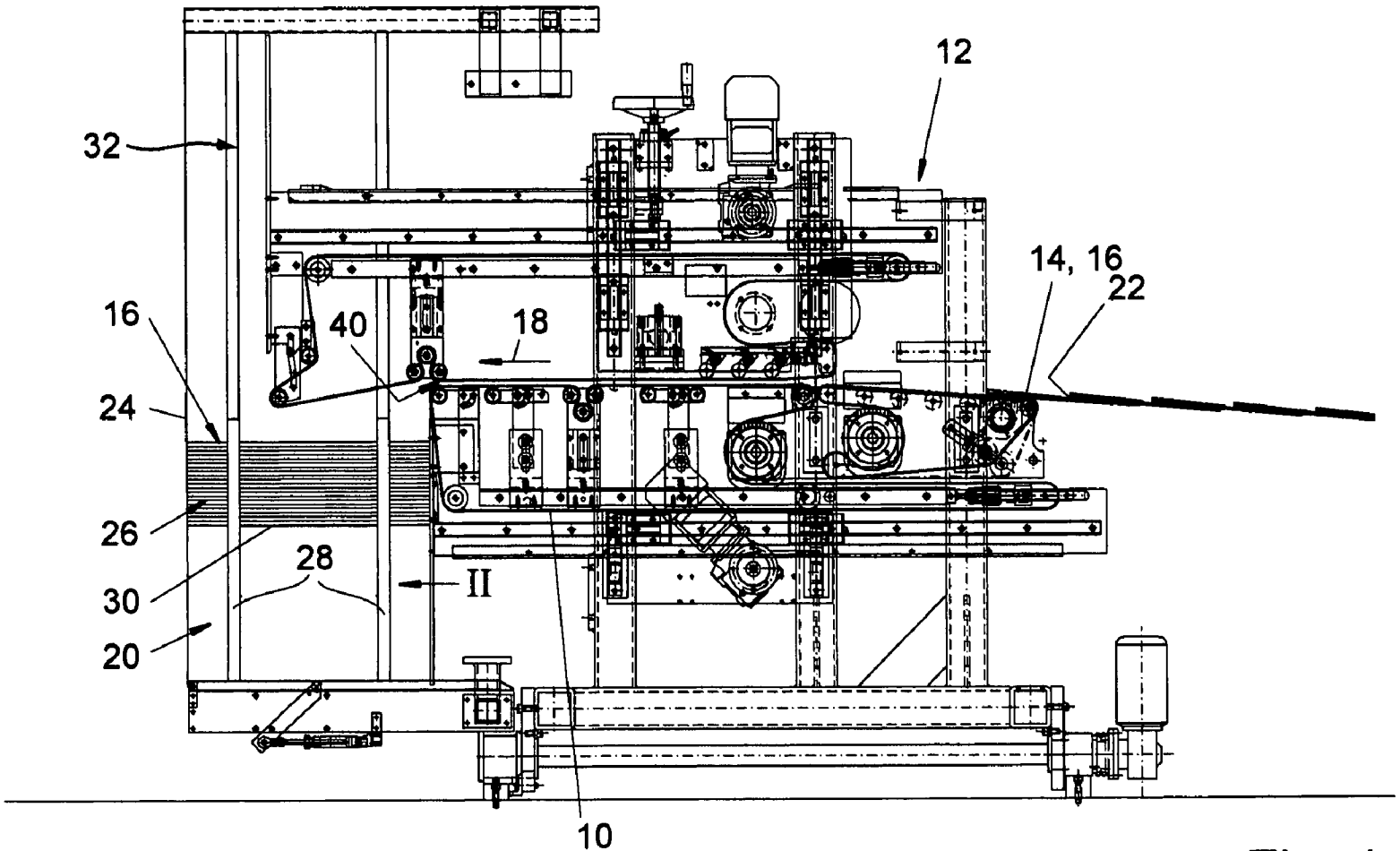
FIG. 1 shows a side view of a removal unit comprising a stacking device.
Figure 2:
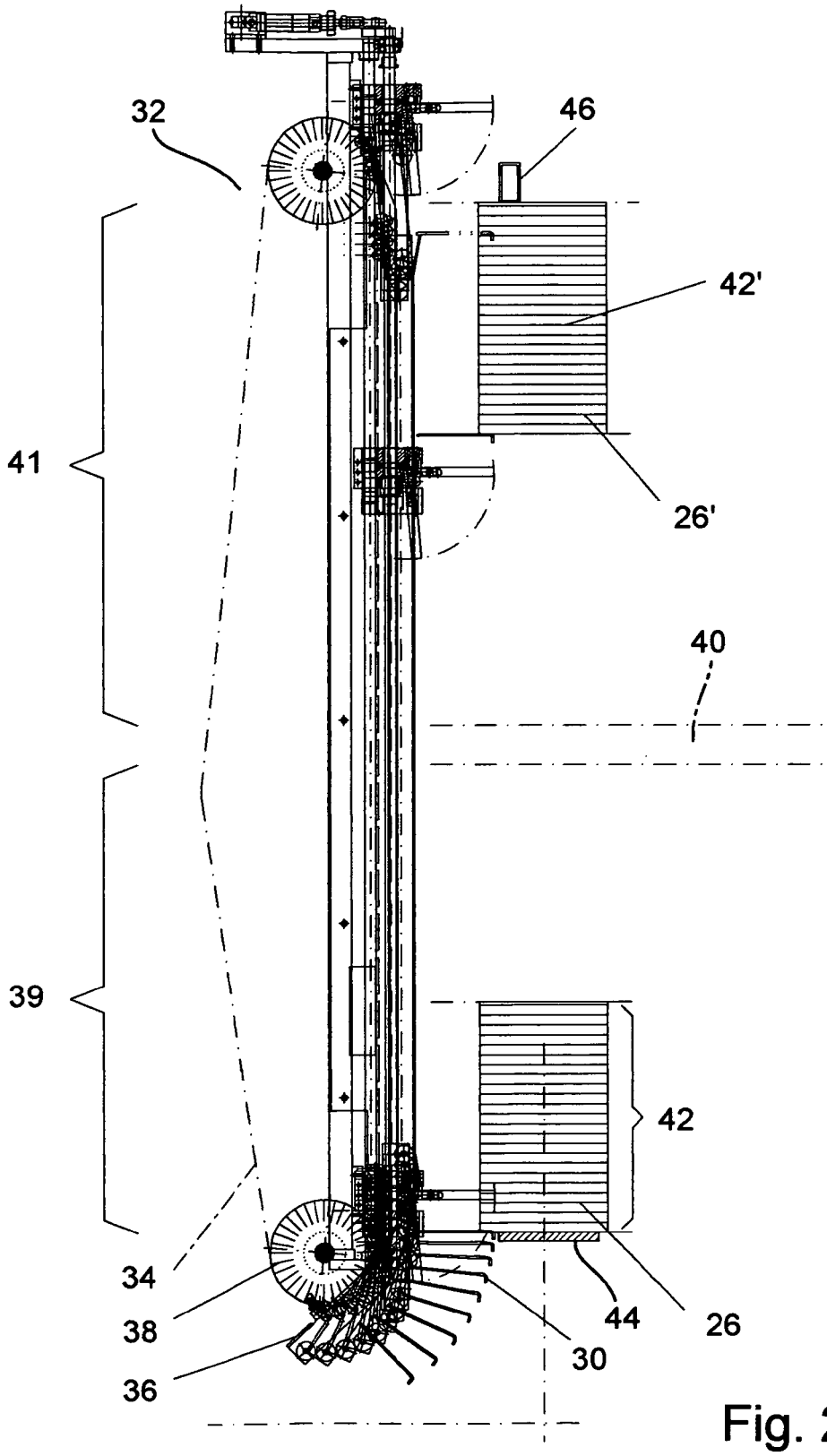
FIG. 2 shows a view in the direction of the arrow II in accordance with FIG. 1 onto a part of the stacking device.

FIG. 1 shows a delivery belt designated with reference numeral 10 which circulates in a device (designated in total with 12) for transporting flat products 14, in particular, folding boxes 16. The individual folding boxes 16 are transported into a stack shaft 20 at high speed in the transport direction (arrow 18). The front edges 22 of the folding boxes 16 strike an impinging surface 24 and are thereby decelerated. FIG. 1 shows a device 12 for down-stacking, i.e. a stack 26 is formed by down-stacking superposed folding boxes 16. This stack 26 is laterally guided by guiding elements 28, as is described in detail below. The stack 26 is formed on a tray 30 and is supported thereby. The tray 30 is located on a transport means 32, schematically shown in FIG. 1 and in detail in FIG. 2. This transport means 32 has a circulating chain 34 with carriage 36 and tray 30 mounted thereto. FIG. 2 shows different positions of the carriage 36 which is guided by the chain 34 about a lower deflecting roller 38. A total of three carriages 36 of this type are mounted to the chain 34 at regular intervals. The tray 30 is located on the carriage 36 and supports the stack 26. The carriage 36 is held and guided on its longitudinal sides by two chains 34 which are housed in the guiding elements 28.

FIG. 2 shows both stacking types, i.e. down-stacking 39 and up-stacking 41. The lower stack 26 is formed by transporting folding boxes 16 through an inlet opening 40 into the stack shaft 20 and disposing them on top of the stack 26. The stack 26 is then lowered by downward displacement of the carriage 34 by the thickness of the folding box 16 such that the next folding box 16 can again be deposited on top of the stack 26. When the stack 26 has reached the maximum stack height and the pile 42 is finished, it is moved into its lowermost position by lowering the carriage 36 to permit removal of the pile 42 from the stack shaft. The pile 42 is thereby supported on a support 44 such that the carriage 36 can be moved further, and the pile 42 is removed from the tray 30. The next carriage 36 arrives at an increased speed from above and is positioned in the region of the inlet opening such that the first folding box 16 of the new stack 26 can be disposed on its tray 30. The carriage 36 then moves downwards with reduced speed, controlled by sensors of a light barrier.

During up-stacking 41, the stack 26' is formed without a tray 30 since the subsequent folding boxes 16 are always disposed at the bottom of the stack 26'. In contrast to FIG. 1, the delivery belt 10 delivering the folding box 16 thereby extends to the region of the impinging surface 24. This ensures that the folding box 16 is safely pushed below the stack 26'. The two trays 30 are located on the side next to the delivery belt 10, i.e. the delivery belt 20 is positioned between the trays 30. The trays 30 are necessary for up-stacking 41 only for delivering the finished stack 26' and not, as is the case for down-stacking 39, for the stacking process itself.

The transport means 32 comprises a second chain (not shown) with a holding-down means 76 mounted thereto which is supported on the stack 26' (FIG. 3). As soon as a folding box 16 has been pushed below the pile 26', the holding-down means 76 is lifted by the thickness of the folding box 16 through transport of the second chain (see FIGS. 3*a* and 3*b*).

Figure 3D:
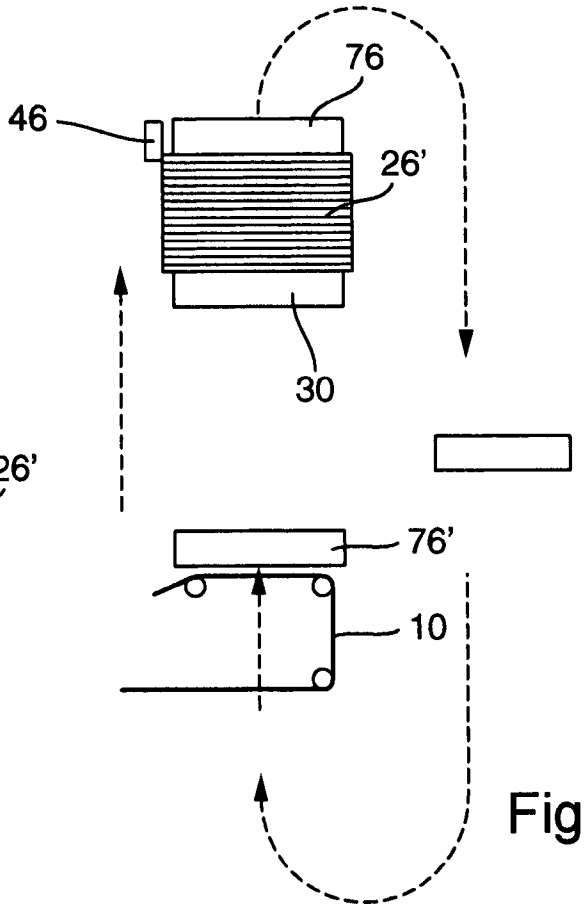
FIGS. 3*a* to 3*d* schematically show the up-stacking process.
Figure 3C:
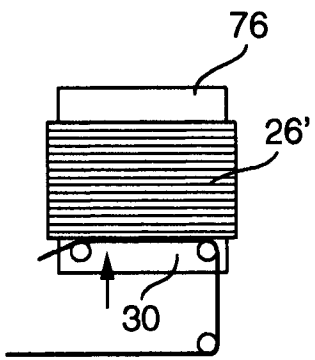

When the stack 26' has reached its maximum stack height, the pile 42' is moved upwards through movement of the carriage 36 with tray 30 from a lower, inoperative position up to the finished pile 42' (FIG. 3*c*) and lifts the stack at high speed until the stacks abuts against a stop 46 (FIG. 3*d*). As soon as the pile 42' has been removed from the stacking region, a new stack 26' is formed. The next holding down means 76' is previously moved, at high speed, from its inoperative position below the delivery belt 10 into a position above the delivery belt 10 such that the first folding box 16 can be pushed below this holding-down means 76'. The holding-down means 76' is then gradually lifted by the thickness of the supplied folding boxes 16, controlled by a sensor, and the next stack 26' is formed.

Figure 3B:
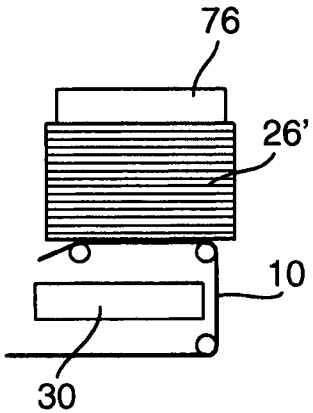
Figure 3A:
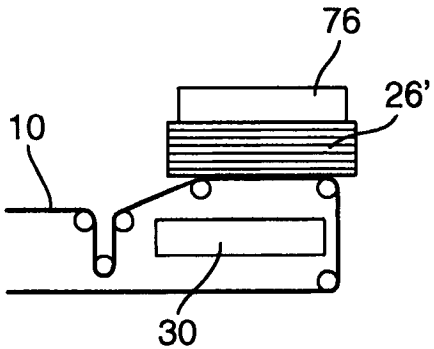

In the meantime, the finished pile 42' is fetched by a suitable gripper in the upper position such that the tray 30 is again free. The carriage 36 and the free tray are then moved into an initial position such that the next tray 30 is waiting at a separation below the forming stack 26' (FIGS. 3*a* and 3*b*).

The holding-down means can also be used for down-stacking 39 by moving it to the forming stack 26 at a separation therefrom, leaving a gap for pushing the folding box 16 between stack 26 and holding-down means. This may be advantageous for folding boxes with extremely irregular thickness.

In any event, the carriage 36 can be moved in a downward direction, i.e. for down-stacking 39, and also in an upward direction for up-stacking 41. When changing the folding box 16, change of the stack shaft 20 which stacks the other folding box 16 in the other stacking mode is no longer required. Both stacking modes can be carried out in the same stack shaft 20.

Figure 4:
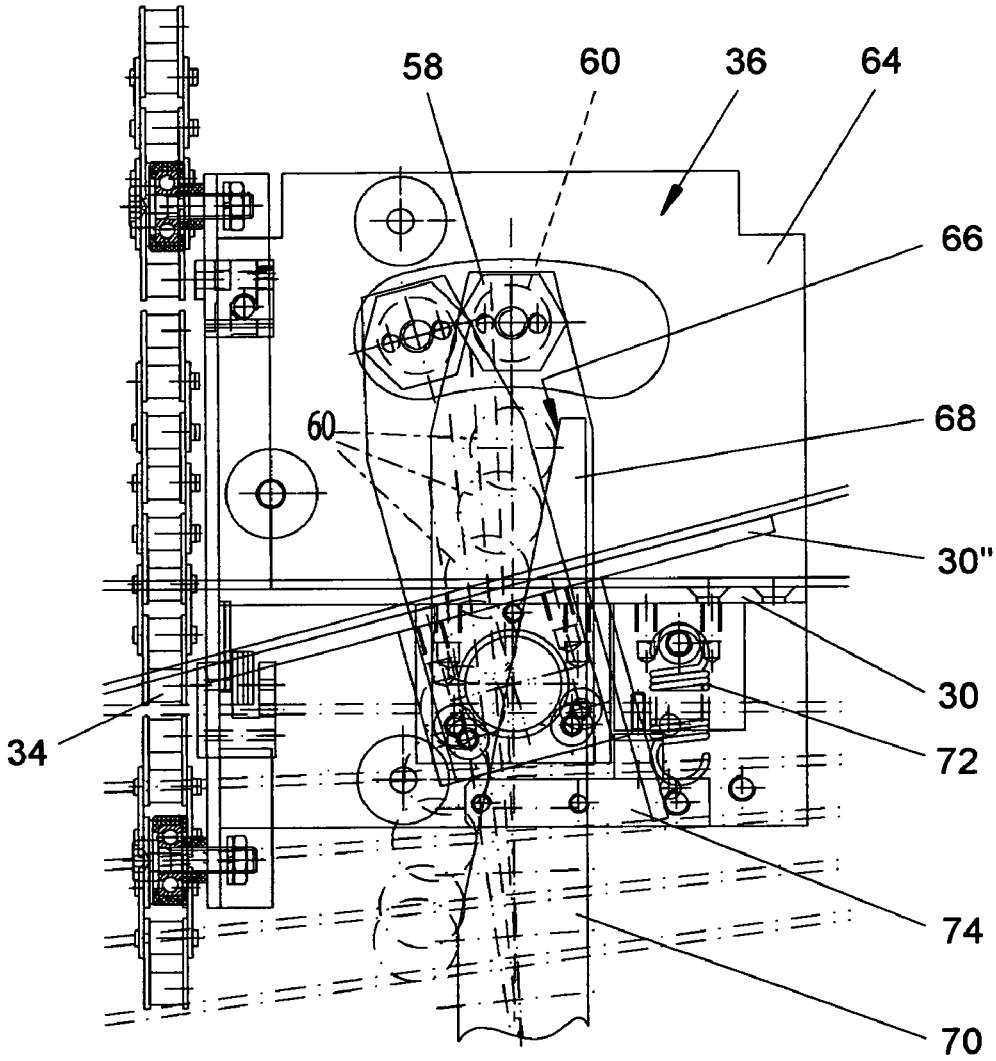
FIG. 4 schematically shows tilting of a tray.
Figure 5:
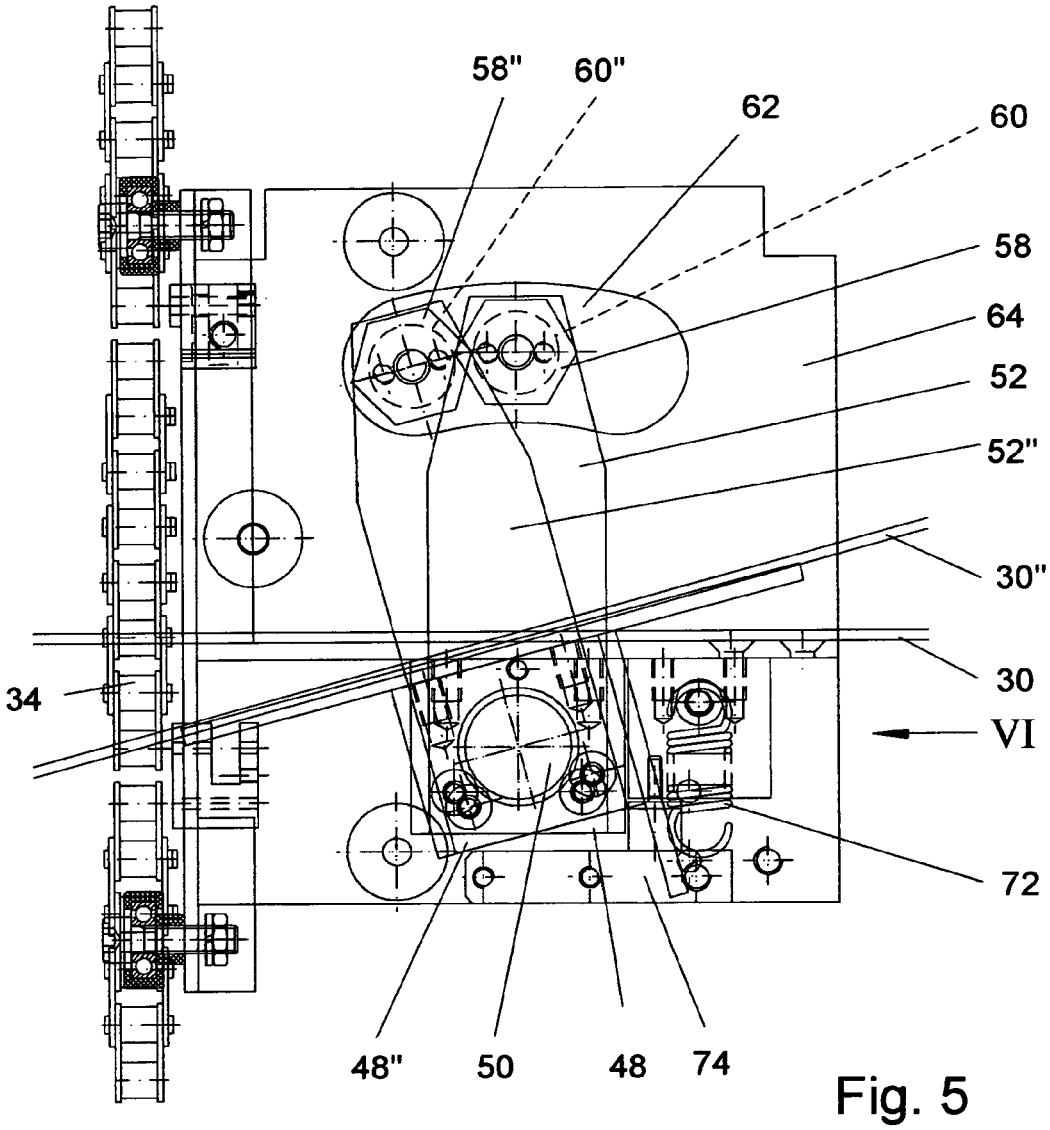
FIG. 5 shows the tray in the tilted and horizontal positions.
Figure 6:
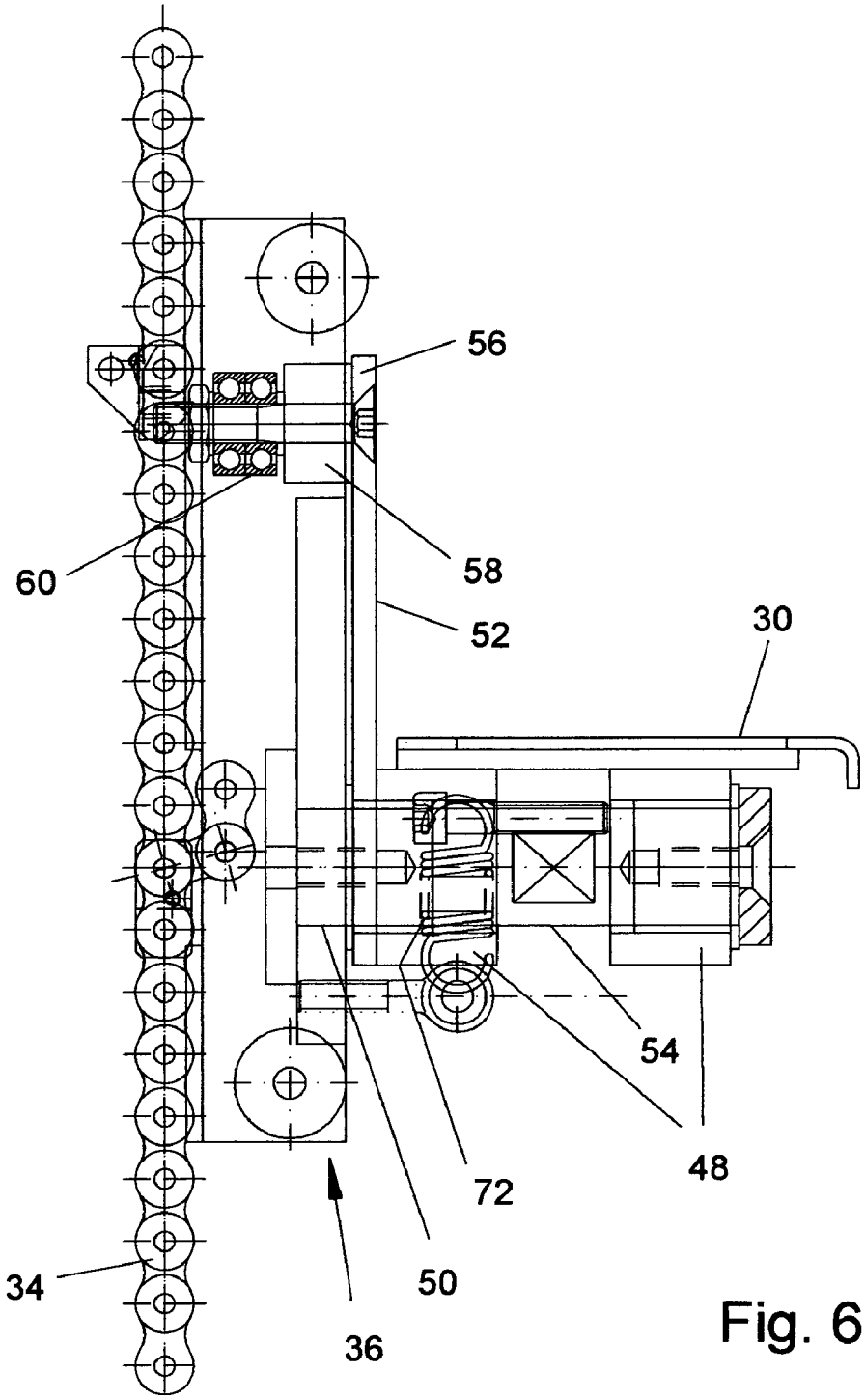
FIG. 6 shows a view in the direction of arrow VI in accordance with FIG. 5.

FIGS. 4, 5, and 6 show the carriage 36 and the tray 30 in a horizontal position and also in a pivoted position 30". Towards this end, the tray 30 is mounted to a bearing block 48 which can be pivoted about a pivot bearing 50. A pivot lever 52 is moreover fixed to the bearing block 48, and can also be pivoted together with the bearing block 48 about the pivot bearing 50. Pivoting is effected by a shaft 54 which penetrates through the bearing block 48.

The free end 56 of the pivot lever 52 has a hexagon bolt 58 with a feeler roller 60, wherein the hexagon bolt 58 and feeler roller 60 penetrate through a kidney-shaped opening 62 in a side wall 64 of the carriage 36. FIGS. 4, 5, and 6 also show that the carriage 36 is mounted to the chain 34.

When the carriage 36 is gradually moved downwards (FIG. 4), the feeler roller 60 abuts an inclined surface 66 of a ramp 68 and is gradually deflected to the left from this ramp 68 (shown by a plurality of feeler roller 60 positions). Deflection of the feeler roller 60 to the left pivots the pivot lever 52 in a counter-clockwise direction (see FIGS. 4 and 5). The pivoted position is shown by reference numerals with double primes. Pivoting of the pivot lever 52" also pivots the bearing block 48" thereby tilting the tray 30". Folding boxes 16 having a substantially wedge-shaped cross-section can thereby be disposed on the tray 30".

The inclined surface 66 merges into a straight surface 70 after reaching the maximum inclination of the pivot lever 52 (15°). At the lower end of the ramp 68, the pivot lever 52 is pivoted by a correspondingly receding inclined surface (not shown) back into its initial position in which the tray 30 re-assumes its horizontal position.

The horizontal position represents a stable rest position for the tray 30. In this position, the tray 30 is held by a tension spring 72 which is mounted at one side to the side wall 64 and, on the other side, to a holder on the lower side of the tray 30. The tray 30 is held in the horizontal rest position via the tension spring 72 and abuts a stop 74. The tray 30 is lifted from this stop 74 only when the pivot lever 52 is deflected, i.e. is actively pivoted. Stacking of folding boxes 16 having a substantially wedge-shaped cross-section is thereby facilitated.

I claim:

1. A device for stacking flat products, such as folding boxes, the device comprising:

a frame defining a stack shaft for receiving the flat products, said stack shaft having an upper region, a lower region, and means defining an inlet opening disposed between said upper region and said lower region;

side flanks for lateral containment of the flat products;

transport means disposed on each of said side flanks; means for conveying the flat products to pass through said inlet opening and into said stack shaft, said conveying means having a downward stacking configuration with which the flat products move downwardly into said lower region of said stack shaft past a forward end of said conveying means to form a downward stack of flat products, said downward stack thereby having a height which increases in a downward direction during top down stacking of the flat products, said conveying means having a upward stacking configuration in which the flat products seat on said conveying means during successive introduction of flat products beneath a vertically increasing upward stack of flat products extending into said upper region of said stack shaft, said upward stack thereby having a height which increases in an upward direction during bottom up stacking of the flat products;

a tray projecting into said stack shaft to carry and guide the flat products, said transport means successively lowering said tray during said top down stacking procedure and said transport means raising said tray to lift a stack of flat products following completion of said bottom up stacking procedure;

a pivot mechanism connected between said tray and said transport means, said pivot mechanism having a substantially horizontal pivot axis about which said tray pivots relative to said transport means;

a pivot lever having a first end cooperating with said tray, said pivot lever extending in a substantially vertical direction in a non-pivoted, substantially horizontal position of said tray, said pivot lever having a second end disposed at a vertical separation from said tray and from said pivot mechanism; and a cam, said cam cooperating with said frame and having a cam surface which engages with said second end of said pivot lever to tilt said pivot lever away from a vertical orientation when said transport means move said tray and said pivot lever cast said cam, thereby causing said tray to tilt about said pivot axis.

2. The device of claim 1, wherein said tray can be moved continuously, in steps, or at different speeds.

3. The device of claim 1, wherein said transport means comprises two adjacent chains which drive a carriage for motion on a guiding rail.

4. The device of claim 3, wherein said pivot mechanism is disposed on said carriage.

5. The device of claim 1, wherein a said second end of said pivot lever has a feeler roller, said feeler roller deflecting through cooperation with said cam.

6. The device of claim 1, wherein said tray is spring-loaded in a direction of a horizontal rest position thereof.

7. The device of claim 5, wherein said cam can be retracted from and introduced into a path of travel of said feeler roller and can be completely or partially removed therefrom.

8. The device of claim 5, wherein an inclination of said cam on which said feeler roller engages can be adjusted.

9. The device of claim 1, wherein a detected stack height serves to control said transport means.

10. The device of claim 1, wherein said tray supports the flat products in a region of opposite side edges thereof.

11. The device of claim 1, further comprising an acceptance device for a product pile, disposed at a lower end of the stack shaft, wherein said trays pass by said acceptance device without collision.

12. The device of claim 11, wherein said acceptance device comprises a means for holding down the product pile.

13. The device of claim 11, further comprising unfoldable guiding strips for the product pile disposed in a region of the removal openings of the stack shaft.

* * * * *